US007741823B2

(12) United States Patent
Terry et al.

(10) Patent No.: US 7,741,823 B2
(45) Date of Patent: Jun. 22, 2010

(54) LINEAR VOLTAGE REGULATOR WITH IMPROVED LARGE TRANSIENT RESPONSE

(75) Inventors: Stephen C. Terry, Knoxville, TN (US); Stephen J. Franck, Felton, CA (US)

(73) Assignee: Agere Systems Inc., Allentown, PA (US)

( * ) Notice: Subject to any disclaimer, the term of this patent is extended or adjusted under 35 U.S.C. 154(b) by 463 days.

(21) Appl. No.: 11/668,297

(22) Filed: Jan. 29, 2007

(65) Prior Publication Data

US 2008/0180080 A1 Jul. 31, 2008

(51) Int. Cl.
*G05F 1/56* (2006.01)
*G05F 1/575* (2006.01)

(52) U.S. Cl. ..... 323/273; 323/280

(58) Field of Classification Search ..... 323/273–281, 323/269, 270
See application file for complete search history.

(56) References Cited

U.S. PATENT DOCUMENTS 5,912,550 A * 6/1999 Sharpe-Geisler ..... 323/273
6,249,029 B1 * 6/2001 Bryant et al. ..... 257/351
6,803,809 B2 * 10/2004 Saitoh ..... 327/541
6,856,124 B2 * 2/2005 Dearn et al. ..... 323/280
6,876,036 B2 * 4/2005 Bourdillon ..... 257/347
6,882,513 B2 * 4/2005 Laraia ..... 361/91.1
2006/0261788 A1 * 11/2006 May ..... 323/273

* cited by examiner

*Primary Examiner*—Jeffrey L Sterrett
*Assistant Examiner*—Fred E Finch, III
(74) *Attorney, Agent, or Firm*—Hamilton, DeSanctis & Cha

(57) ABSTRACT

Various voltage regulators and/or voltage regulation systems are disclosed. For example, a voltage regulation system that includes a source follower output is disclosed. The source follower output includes a transistor where the source of the transistor provides a baseline voltage to a regulated voltage output node. The voltage regulation system further includes a body damping circuit and a low speed feedback circuit. The body damping circuit is electrically coupled to the body of the transistor, and is operable to provide a rapid opposition to any voltage disturbance at the regulated voltage output node. The low speed feedback circuit is electrically coupled to the gate of the transistor, and is operable to return the regulated voltage output node to the baseline voltage.

19 Claims, 7 Drawing Sheets

LINEAR VOLTAGE REGULATOR WITH IMPROVED LARGE TRANSIENT RESPONSE

BACKGROUND OF THE INVENTION

The present invention is related to voltage regulation, and more particularly to systems and methods for improving transient response in a voltage regulator.

Many electronic devices such as, for example, hard disk drives, cellular telephones and notebook computers include a number of semiconductor circuits powered by one or more supply voltages. These supply voltages are often generated by voltage regulators that may in some cases be integrated with the particular semiconductor circuits. The voltage regulators may provide a regulated voltage output that is derived from either battery power or some other power supply.

FIG. 1 shows an exemplary voltage regulator 100 with a number of transistors 132, 138, 142, 148, 152, 158, 162, 168, 172, 178, 182, 188, 192, 198 that are powered between voltage potential VDD 104 and VSS 102. In particular, transistor 132 is an NMOS source follower with a capacitor 125 that couples the gate of transistor 132 to VSS 102. Voltage regulator 100 provides a voltage output 120 to a load 130 that is electrically coupled between the source of transistor 132 and VSS 102. In operation, a voltage reference 110 is applied to the gate of transistor 178, and voltage output 120 tracks voltage reference 110. Capacitor 125 operates to oppose any sudden changes in the voltage at the source of transistor 132 (i.e., voltage output 120). Where the value of capacitor 125 is too small, it is possible for voltage output 120 to ring or oscillate upon any sudden change of either voltage reference 110 or load 130. To avoid the possibility of such oscillation, a relatively large value for capacitor 125 is chosen (e.g., at least two times the value of the $C_{gs}$ of transistor 132) to hold the gate of transistor 132 steady. This large value for capacitor 125 limits the initial voltage disturbance at voltage output 120, however, the return to a baseline output value is relatively slow as it relies on the transconductance of transistors 172, 178. This transconductance is typically small compared to the gm of transistor 132 for low power operation.

FIG. 1*b* is a graphical representation 101 of voltage regulator 100 in operation. As shown, voltage regulator 100 is capable of tracking relatively quick changes in voltage reference 110 or load 130 as indicated by operational periods 111, 121, 131. However, the recovery period required to return to a baseline output value is relatively slow as indicated by operational periods 113, 123, 133. Such a slow recovery period may limit the overall switching frequency of a circuit regulated by voltage regulator 100. Such a low frequency may be particularly limiting in storage applications.

Hence, for at least the aforementioned reasons, there exists a need in the art for advanced systems and methods for improving response time in voltage regulators.

BRIEF SUMMARY OF THE INVENTION

The present invention is related to voltage regulation, and more particularly to systems and methods for improving transient response in a voltage regulator.

Some embodiments of the present invention provide voltage regulation systems that include a source follower output. The source follower output includes a transistor where the source of the transistor provides a baseline voltage to a regulated voltage output node. The voltage regulation system further includes a body damping circuit and a low speed feedback circuit. The body damping circuit is electrically coupled to the body of the transistor, and is operable to provide a rapid opposition to any voltage disturbance at the regulated voltage output node. The low speed feedback circuit is electrically coupled to the gate of the transistor, and is operable to return the regulated voltage output node to the baseline voltage.

In some instances of the aforementioned embodiments, a variable load is electrically coupled to the regulated voltage output node. Such a variable load changes the loading of the voltage regulation system during operation thereof. In various instances of the aforementioned embodiments, the body damping circuit is implemented as a body filter. The body filter includes a body resistor that is electrically coupled between the regulated voltage output and the body of the transistor, and a body capacitor that is electrically coupled to the body of the transistor. In other instances of the aforementioned embodiments, the body damping circuit includes a low impedance bias voltage that is applied to the body of the transistor. In one or more instances of the aforementioned embodiments, the voltage regulation systems further include a gate capacitor that is electrically coupled to the gate of the transistor and generates a primary pole of the voltage regulation system.

in some particular instances of the aforementioned embodiments, the low speed feedback circuit includes another transistor. The drain of the other transistor is electrically coupled to the regulated voltage output. Further, a feedback capacitor may be used to create a high speed feedback circuit where it is coupled between the regulated voltage output and the gate of the other transistor. In some such cases, the body damping circuit includes a body filter with a time constant that is less than the time constant of the low speed feedback circuit including the gate capacitor.

Other embodiments of the present invention provide voltage regulators that include a source follower. The source follower includes a transistor where the source of the transistor provides a baseline voltage to a regulated voltage output node. Such voltage regulators further include a gate capacitor that is electrically coupled to the gate of the source follower transistor, and a body filter that includes a body resistor and a body capacitor. Another transistor is included with the drain of the other capacitor being electrically coupled to the regulated voltage output node. In addition, a feedback capacitor is electrically coupled between the gate of the second transistor and the regulated voltage output node. In such embodiments, the body filter is operable to oppose a change in the body voltage of the source follower transistor caused by a change in a variable load driven by the voltage regulator, and the feedback capacitor is operable to provide a rapid return to a baseline voltage at the regulated voltage output node after a change in the variable load.

Yet other embodiments of the present invention provide voltage regulators that include a source follower. The source follower includes a transistor where the source of the transistor provides a baseline voltage to a regulated voltage output node. The voltage regulators further include a gate capacitor that is electrically coupled to the gate of the source follower transistor, and a body filter that is electrically coupled to the body of the source follower transistor.

This summary provides only a general outline of some embodiments according to the present invention. Many other objects, features, advantages and other embodiments of the present invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, like reference numerals are used throughout several figures to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

The present invention is related to voltage regulation, and more particularly to systems and methods for improving transient response in a voltage regulator.

Various embodiments of the present invention include linear voltage regulators that utilize an nMOS source follower as the pass device. In some cases, the linear regulators are modified to include a body filter that allows a reduction in the value of a gate capacitor. In one or more cases, an additional feedback capacitor is added to reduce any ringing occurring due to the reduction in the gate capacitor. By doing such, a voltage disturbance occurring at the output of the voltage regulator that is caused by a large transient load-current step can be minimized without unduly limiting the response time of the voltage regulator. In some cases, a controlled body voltage on the pass device and an auxiliary high-pass feedback loop are utilized to both limit the magnitude of the output voltage disturbance and provide a quick return to the baseline regulated voltage.

Figure 1A:
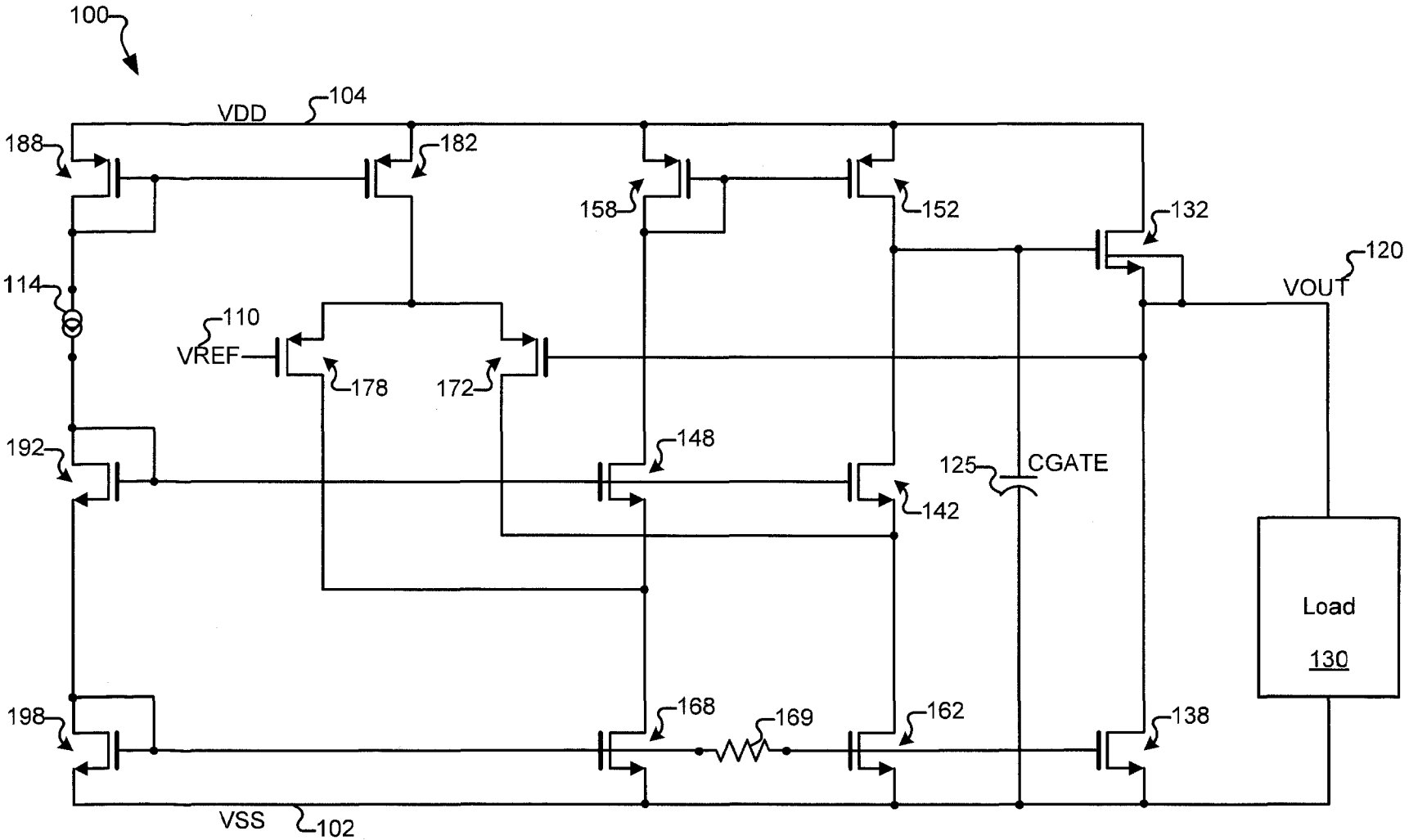
Figure 1a (Prior Art)
FIG. 1*a* depicts an exemplary prior art voltage regulator exhibiting either a potential ringing or slow response time depending upon the chosen gate capacitance value.
Figure 1B:
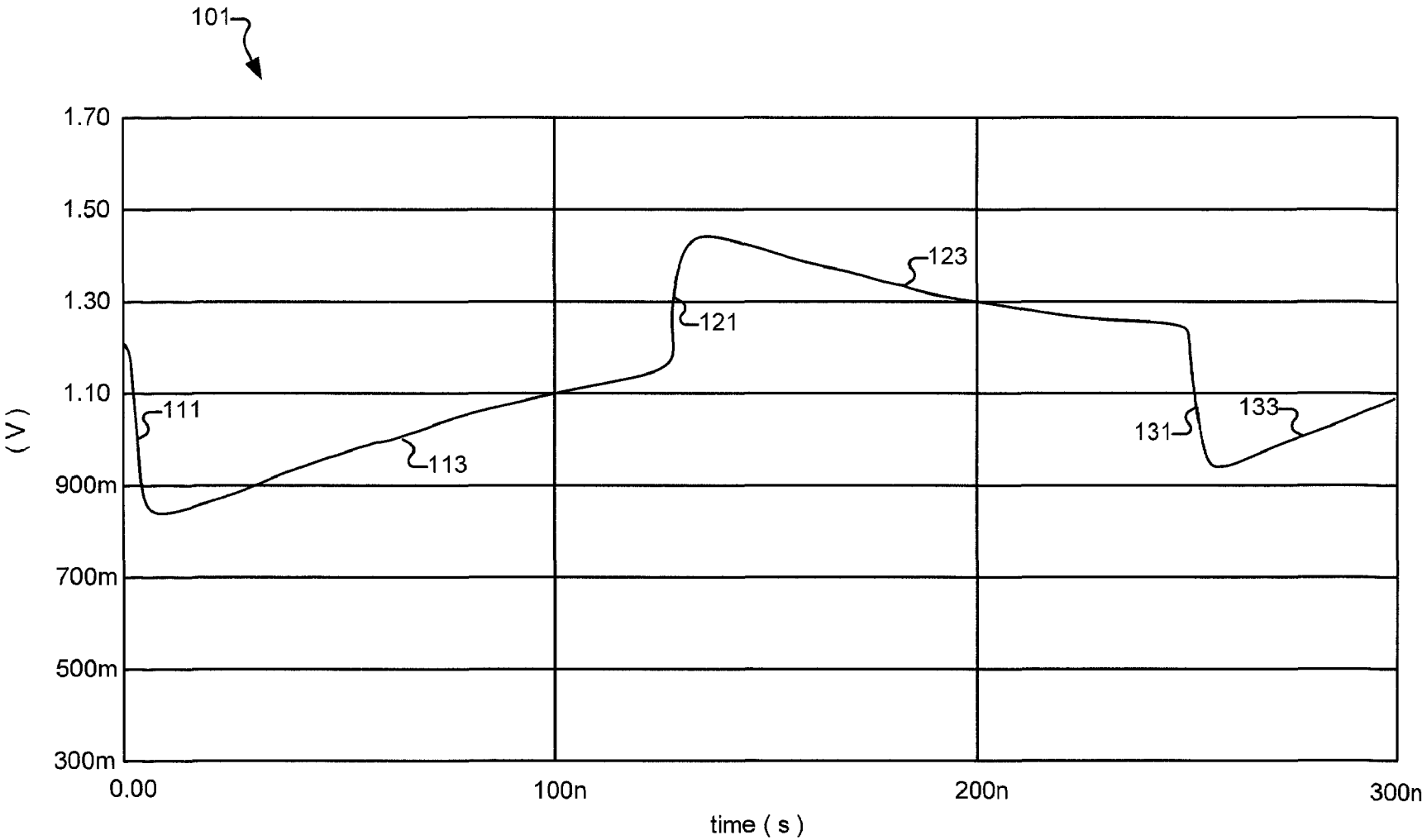
Figure 1b (Prior Art)
FIG. 1*b* depicts an exemplary operation of the voltage regulator of FIG. 1*a* where a relatively large gate capacitance value is chosen.
Figure 2:
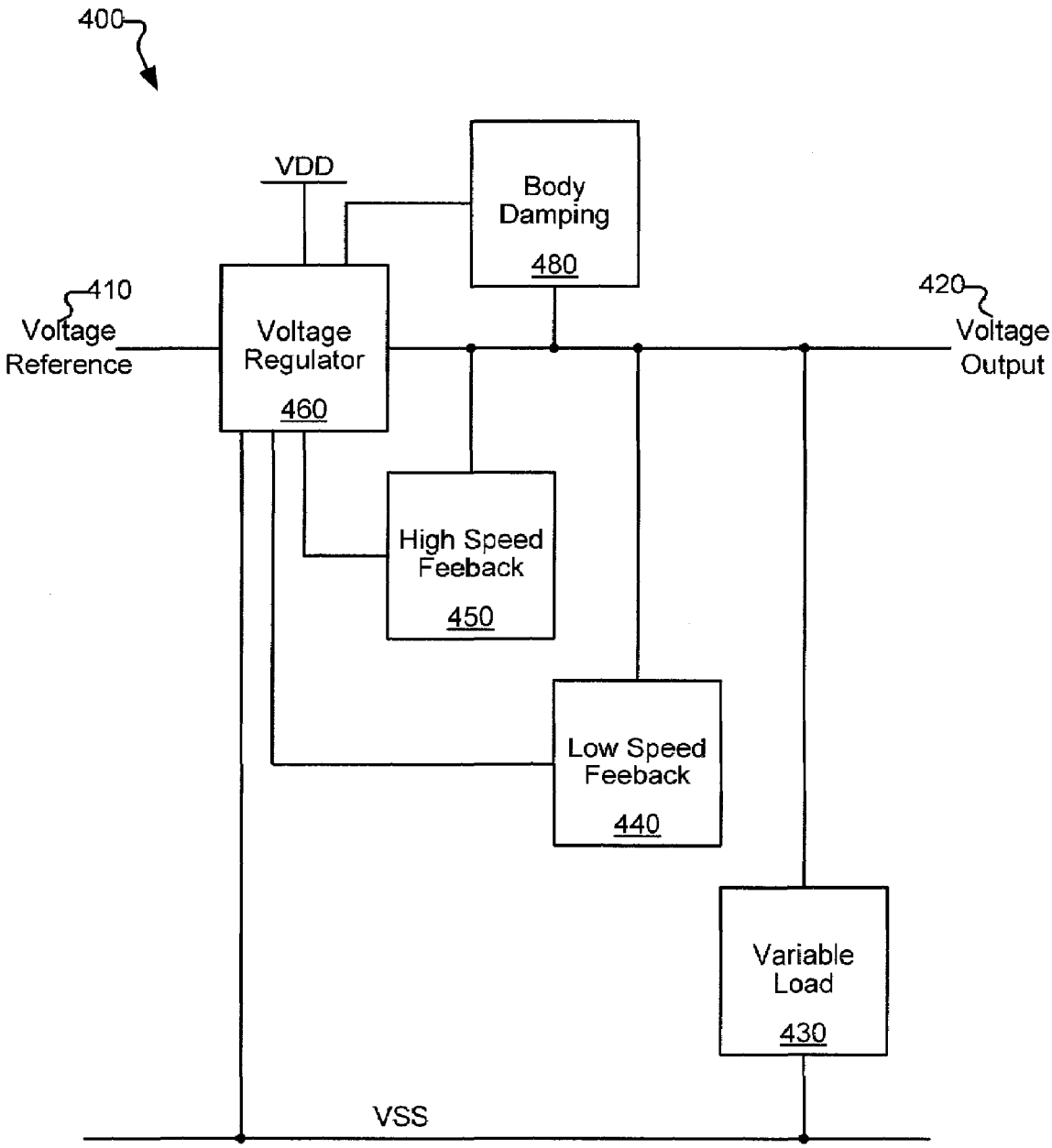
FIG. 2 depicts a voltage regulator in accordance with some embodiments of the present invention.

Turning to FIG. 2, a voltage regulation circuit 400 in accordance with some embodiments of the present invention is depicted. Voltage regulation circuit 400 includes a voltage regulator 460 with a body damping circuit 480, a high speed feedback circuit 450 and a low speed feedback circuit 440. Voltage regulator 460 drives a voltage output 420 that is referenced to a voltage reference 410. Voltage output 420 is applied to a variable load 430. Without body damping circuit 480, high speed feedback circuit 450 and/or low speed feedback circuit 440, very large transient currents may be applied to variable load 430 when the load switches on and off. In particular, when variable load 430 switches on, there is a tendency for the current provided to voltage output 420 to ramp very quickly due to the substantial reduction in variable load 430 that is perceived by voltage regulator 460. Body damping circuit 480 and high speed feedback circuit 450 operates to almost instantaneously oppose the increase in current until low speed feedback circuit 440 can respond and properly correct the disturbance at voltage output 420.

In one particular embodiment of voltage regulation circuit 400, body damping circuit 480 is implemented by coupling a low-pass filter to the body of a transistor configured as an nMOS source follower at the output stage of voltage regulator 460. The source of the aforementioned transistor drives voltage output 420. In such cases, the time constant of the added low-pass filter is much less than the time constant associated with low speed feedback circuit 440. In such cases, the time constant is at least in part controlled by a feedback capacitor. In another particular embodiment of voltage regulation circuit 400, a low impedance bias voltage is applied to the body of the transistor of the nMOS source follower in place of the aforementioned low-pass filter. Use of such a bias voltage provides opposition to a change in the voltage at voltage output 420 similar to that provided by the previously discussed low-pass filter. Exemplary implementations of the aforementioned embodiments are discussed below in relation to FIGS. 3-4.

Figure 3A:
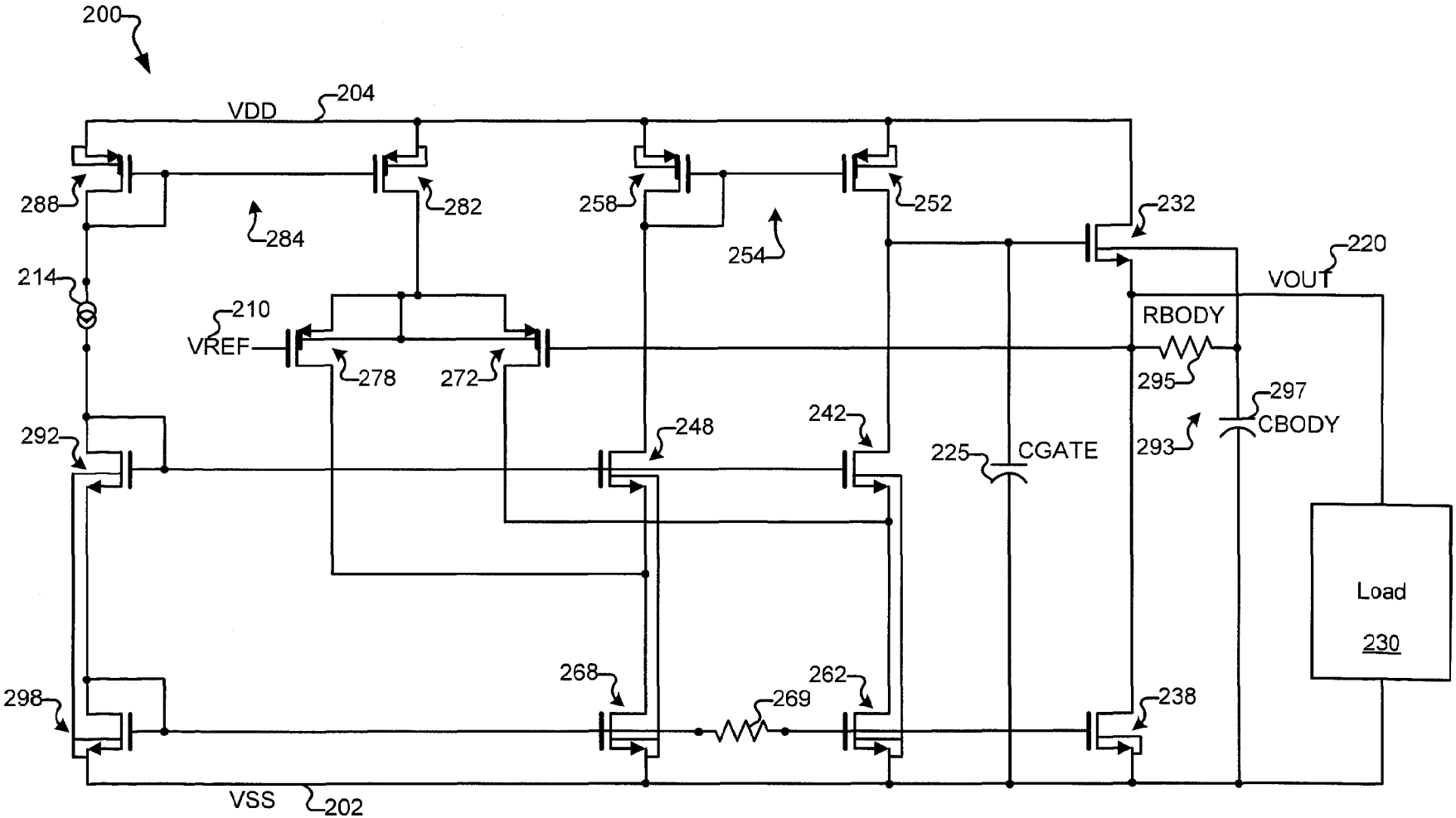
FIG. 3*a* depicts a voltage regulator including a body filter for improving response time in accordance with one or more embodiments of the present invention.

Turning to FIG. 3*a*, a voltage regulator 200 in accordance with one or more embodiments of the present invention is depicted. Voltage regulator 200 includes a differential input pair including a transistor 272 and a transistor 278. The gate of transistor 278 is electrically coupled to a voltage reference 210. The source of each of transistor 272 and transistor 278 are electrically coupled to the other, and to the respective bodies. Further, the source of each of transistor 272 and transistor 278 are electrically coupled to a current mirror 284 formed of a transistor 282 and a transistor 288. In particular, the source of each of transistor 272 and transistor 278 are electrically coupled to the drain of transistor 282. The source and the body of transistor 282 are electrically coupled to a voltage potential VDD 204. The gate of transistor 282 is electrically coupled to the gate and drain of transistor 288. The source and body of transistor 288 are electrically coupled to VDD 204. The drain of transistor 288 is electrically coupled to a current source 214.

Current source 214 is electrically coupled to a voltage potential VSS 202 via a transistor 292 and a transistor 298. The gate of transistor 292 is electrically coupled to the gate of a transistor 248 and the gate of a transistor 242. Similarly, the gate of transistor 298 is electrically coupled to the gate of a transistor 268 and to the gate of a transistor 262 (via a resistor 269). The drain of transistor 278 is electrically coupled to both the source of transistor 248 and the drain of transistor 268, and the drain of transistor 272 is electrically coupled to both the source of transistor 242 and the drain of transistor 262. The drains of transistors 242, 248 are each electrically coupled to a current mirror 254. In particular, the drain of transistor 248 is electrically coupled to the drain and source of a transistor 258, and the drain of transistor 262 is electrically coupled to the drain of a transistor 252. All of the source and the body of transistor 258 and the source and body of transistor 252 are electrically coupled to VDD 204. The gate of transistor 252 is electrically coupled to both the gate and drain of transistor 258. The body of transistor 248 is electrically coupled to the body of transistor 268, and each are electrically coupled to the source of transistor 268. Similarly, the body of transistor 242 is electrically coupled to the body of transistor 262, and each are electrically coupled to the source of transistor 262.

The drain of transistor 252 is electrically coupled to the gate of pass transistor 232, and to VSS 202 via a capacitor 225 (at times referred to as gate capacitor). The drain of transistor 232 is electrically coupled to VDD 204. The source of transistor 232 is electrically coupled to VSS 202 via a transistor 238. In particular, the drain of transistor 238 is electrically coupled to the source of transistor 232, the gate of transistor 238 is electrically coupled to the gate of transistor 262, and the body and source of transistor 238 are electrically coupled to VSS 202. Both the source of transistor 232 and the gate of transistor 272 are electrically coupled to voltage output 220. Further, the body of transistor 232 is electrically coupled to voltage output 220 via a resistor 295, and voltage output 220 is electrically coupled to VSS 202 via a body filter 293 comprising resistor 295 and a capacitor 297. The connection of body filter 293 to the body of transistor 232 provides a body damping circuit as discussed above in relation to FIG. 2. Load 230 is electrically coupled between voltage output 220 and VSS 202.

Load 230 is variable, and may dramatically change the load seen by voltage regulator 200 depending upon the switching dynamics of the circuit that load 230 represents. For example, when the circuit represented by load 230 is switched on or off, the change in the load seen by voltage regulator circuit 200 may be substantial and result in corresponding substantial steps in the current supplied to load 230. In contrast, smaller current steps may be generated during the normal operational switching of load 230. Such current steps complicate voltage regulation offered by voltage regulator 200. As one example, when load 230 is substantially reduced, there is an immediate increase in the current supplied to load 230 as voltage regulator 200 seeks to maintain voltage output 220 constant. This change in current is communicated within voltage regulator circuit as a voltage error compensated by the differential pair of transistors 272, 278. Differential transistor pair 272, 278 integrates a growing error between voltage output 220 and voltage reference 210 by generating a differential current in transistors 272, 278 that integrates across capacitor 225. The integration on capacitor 225 causes a change in the voltage at the gate of transistor 232. By changing the voltage applied to the gate of transistor 232, voltage output 220 is changed. The low speed feedback circuit discussed in relation to FIG. 2 may include transistor 272.

Body filter 293 (i.e., body damping circuit 480) adds a time constant between the body of transistor 232 and voltage output 220. This time constant operates as a filter that minimizes any ringing that may occur when load 230 is switching. Further, when voltage output 220 droops, capacitor 297 of body filter 293 operates to hold the body of transistor 232 high for a limited period of time. This causes transistor 232 to supply an increased current to voltage output 220 for a short period of time (i.e., provides an increased conductance for a short period of time). This increase in current improves both the phase margin of voltage regulator 200, as well as the instantaneous response of voltage regulator 200.

In alternative embodiments of the present invention, body filter 293 may be replaced with a low impedance source (not shown) whose voltage is near, but always less than the desired output voltage of regulator 200. This low impedance source would be connected to the body of transistor 232. Such a low impedance source would provide a similar current boost as that provided by body filter 293.

Figure 3B:
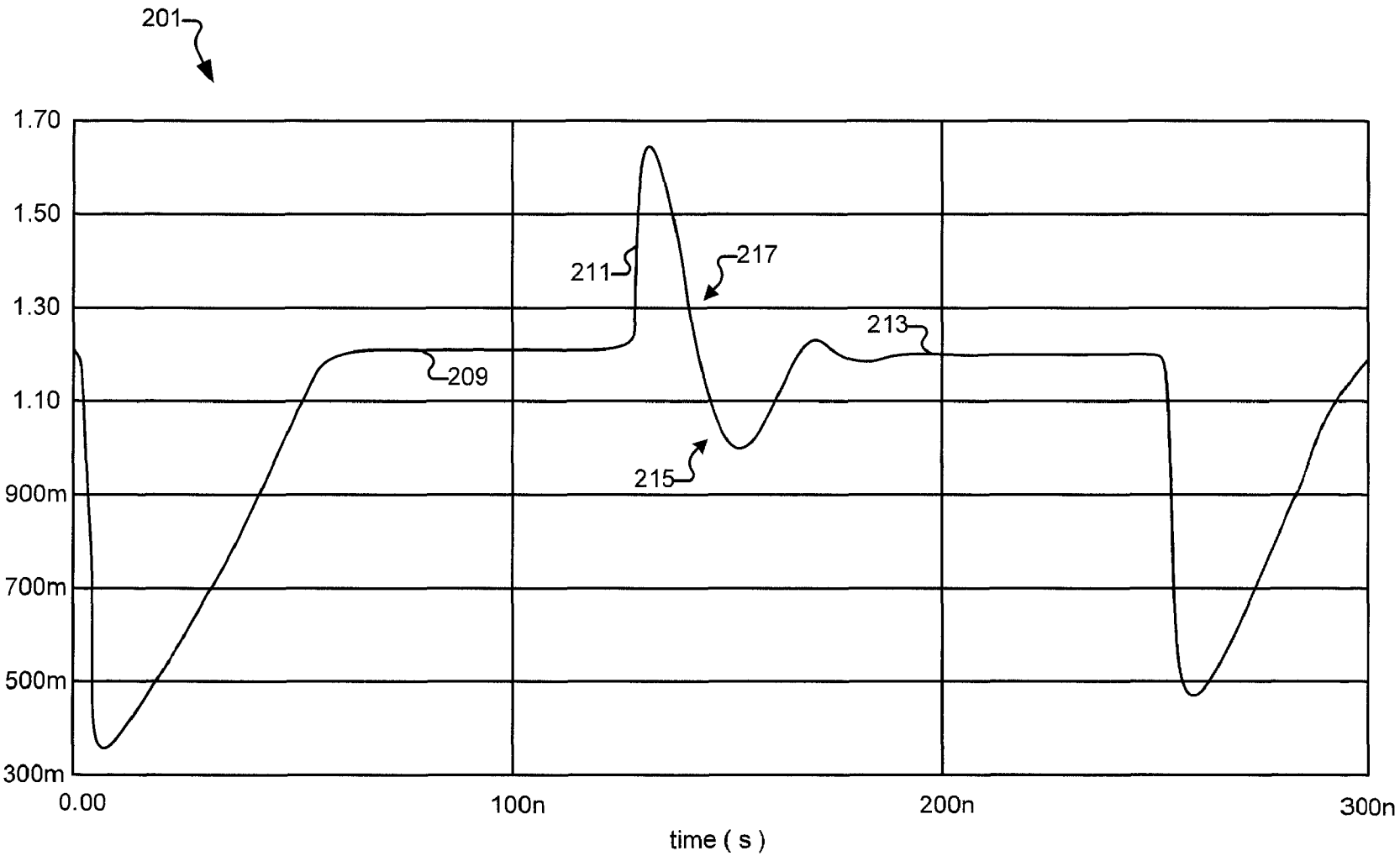
FIG. 3*b* depicts an exemplary operation of the voltage regulator of FIG. 3*a* where a reasonably sized body filter is chosen.

Turning to FIG. 3*b*, a graphical representation 201 depicts an exemplary operation of voltage regulator 200. Graphical representation 201 shows a typical load current waveform for voltage regulator 200 operating at 1.2 Volts without capacitor 225. As shown by graphical representation 201, voltage regulator 200 provides a reasonably fast response time (time from point 211 to point 213 which is less than seventy nanoseconds), but with a significant voltage disturbance (greater than 0.4V) at the output of voltage regulator 200 (i.e., voltage output 220). It should be noted that graphical representation 201 shows the operation of voltage regulator 200 either without capacitor 225, or with only a very low value of capacitor 200. Based on the disclosure provided herein, one of ordinary skill in the art will recognize that adding capacitor 225 impacts region 209, and will dampen the ringing noted at region 215. This will provide some improvement to the significant voltage disturbance, and may increase the response time as the amount of ringing is reduced.

As shown, load 230 is switched on at a point 211 resulting in a dramatic increase in the voltage at voltage output 220 (i.e., a large transient voltage disturbance). Because capacitor 225 is removed, the voltage disturbance caused by switching load 230 off will be applied to the gate of transistor 232 which moves with the source of that transistor. This effect is due to insufficient capacitance (i.e., as capacitor 225 is not included) to absorb the charge fed through $C_{gs}$ of transistor 232. The large transient occurs because immediately after the load circuits turn on, there is nothing to oppose a change in the voltage at the source of transistor 232.

After some amount of time the aforementioned output disturbance will propagate through the body damping circuit which will then drive the gate of transistor 232 in opposition to the source of that transistor. This provides a quick return to baseline operation (i.e., operation at point 213). However, in this case the signal that is fed back is inverted before it gets to the gate of transistor 232. Such an inversion results in some signal delay. During this delay period a significant voltage disturbance may be generated at voltage output 220. Once the feedback process begins, the voltage is reduced as indicated by region 217. This results in an undershoot (i.e., ringing) that is resolved by a point 213. Again, as previously discussed, where capacitor 225 is added, such overshoot and undershoot are reduced, as well as the ringing.

Figure 4A:
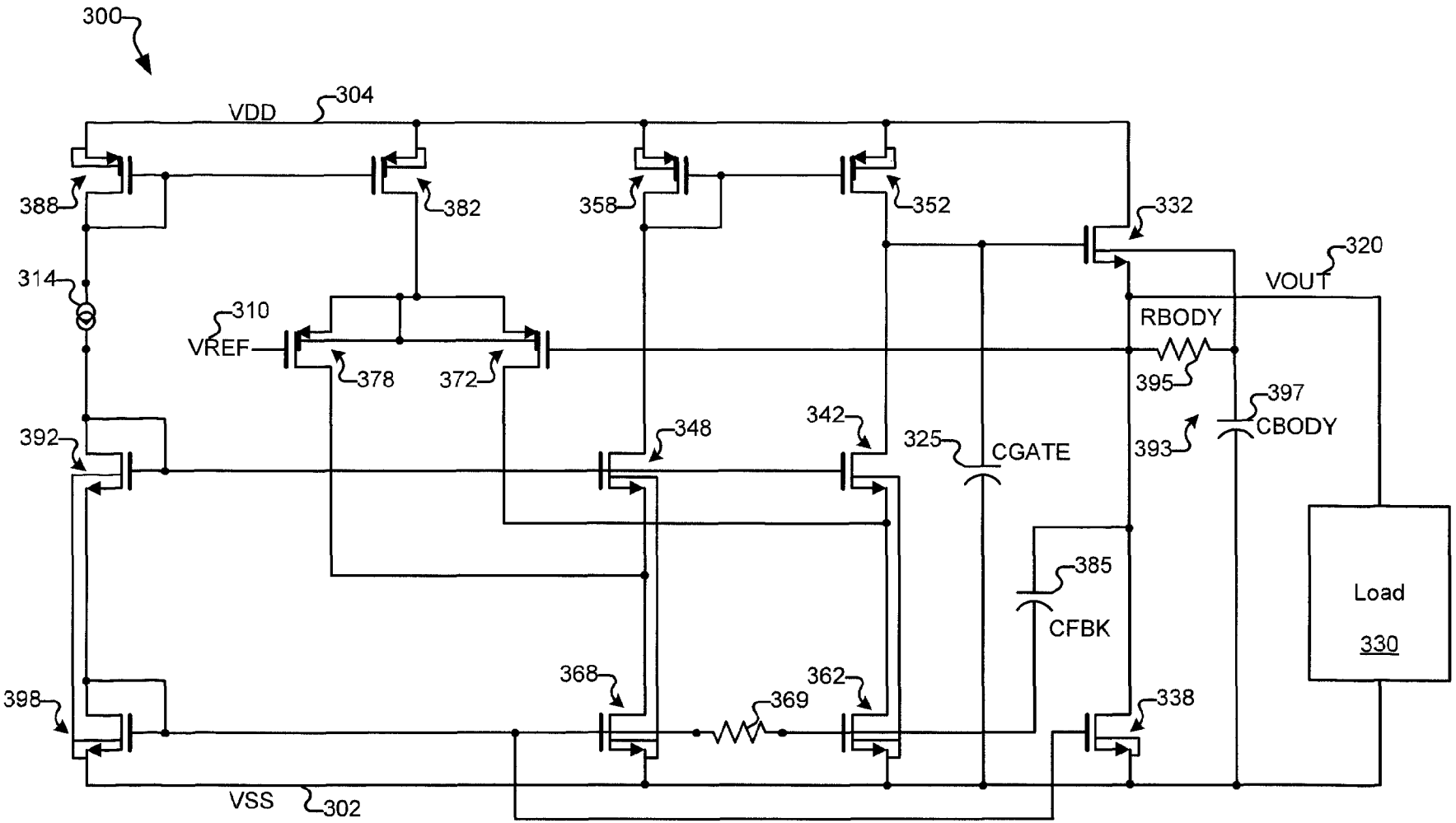
FIG. 4*a* depicts another voltage regulator including a body filter and feedback capacitor for improving transient response in accordance with various embodiments of the present invention.

Turning to FIG. 4*a*, a voltage regulator 300 in accordance with other embodiments of the present invention is depicted. Voltage regulator 300 includes a differential input pair including a transistor 372 and a transistor 378. The gate of transistor 378 is electrically coupled to a voltage reference 310. The source of each of transistor 372 and transistor 378 are electrically coupled to the other, and to the respective bodies. Further, the source of each of transistor 372 and transistor 378 are electrically coupled to a current mirror 384 formed of a transistor 382 and a transistor 388. In particular, the source of each of transistor 372 and transistor 378 are electrically coupled to the drain of transistor 382. The source and the body of transistor 382 are electrically coupled to a voltage potential VDD 304. The gate of transistor 382 is electrically coupled to the gate and drain of transistor 388. The source and body of transistor 388 are electrically coupled to VDD 304. The drain of transistor 388 is electrically coupled to a current source 314.

Current source 314 is electrically coupled to a voltage potential VSS 302 via a transistor 392 and a transistor 398. The gate of transistor 392 is electrically coupled to the gate of a transistor 348 and the gate of a transistor 342. Similarly, the gate of transistor 398 is electrically coupled to the gate of a transistor 368 and to the gate of a transistor 362 (via a resistor 369). The drain of transistor 378 is electrically coupled to both the source of transistor 348 and the drain of transistor 368, and the drain of transistor 372 is electrically coupled to both the source of transistor 342 and the drain of transistor 362. The drains of transistors 342, 348 are each electrically coupled to a current mirror 354. In particular, the drain of transistor 348 is electrically coupled to the drain and source of a transistor 358, and the drain of transistor 362 is electrically coupled to the drain of a transistor 352. All of the source and the body of transistor 358 and the source and body of transistor 352 are electrically coupled to VDD 304. The gate of transistor 352 is electrically coupled to both the gate and drain of transistor 358. The body of transistor 348 is electrically coupled to the body of transistor 368, and each are electrically coupled to the source of transistor 368. Similarly, the body of transistor 342 is electrically coupled to the body of transistor 362, and each are electrically coupled to the source of transistor 362.

The drain of transistor 352 is electrically coupled to the gate of pass transistor 332, and to VSS 302 via a capacitor 325 (at times referred to as gate capacitor). The drain of transistor 332 is electrically coupled to VDD 304. The source of transistor 332 is electrically coupled to VSS 302 via a transistor 338. In particular, the drain of transistor 338 is electrically coupled to the source of transistor 332, the gate of transistor 338 is electrically coupled to the gate of transistor 362, and the body and source of transistor 338 are electrically coupled to VSS 302. Both the source of transistor 332 and the gate of transistor 372 are electrically coupled to voltage output 320. Further, the body of transistor 332 is electrically coupled to voltage output 320 via a resistor 395, and voltage output 320 is electrically coupled to VSS 302 via a body filter 393 comprising resistor 395 and a capacitor 397. Load 330 is electrically coupled between voltage output 320 and VSS 302. Voltage regulator 300 further includes a feedback capacitor 385 electrically coupled between the source of transistor 332 and the gate of transistor 338. As described below, capacitor 385 provides another feedback path that can be used to cause voltage output 320 to exhibit less disturbance when load 330 is switched. The connection of body filter 393 to the body of transistor 332 provides a body damping circuit as discussed above in relation to FIG. 2; the high speed feedback circuit of FIG. 2 includes transistor 362 and feedback capacitor 385 in combination with gate capacitor 225; and the low speed feedback circuit of FIG. 2 includes transistor 372 in combination with gate capacitor 225.

As alluded to, load 330 is variable and may dramatically change the load seen by voltage regulator 300 depending upon the switching dynamics of the circuit that load 330 represents. For example, when the circuit represented by load 330 is switched on or off, the change in the load seen by voltage regulator circuit 300 may be substantial and result in corresponding substantial steps in the current supplied to load 330. In contrast, smaller current steps may be generated during the normal operational switching of load 330. Such current steps complicate voltage regulation offered by voltage regulator 300. As one example, when load 330 is substantially reduced, there is an immediate increase in the current supplied to load 330 as voltage regulator 300 seeks to maintain voltage output 320 constant. There are two ways to communicate this change in load 330 within voltage regulator 300. The first is similar to that discussed above in relation to voltage regulator 200 where the differential pair of transistors 372, 378 integrate a growing error between voltage output 320 and voltage reference 310. In particular, the difference between voltage reference 310 and voltage output 320 generates a differential current in transistors 372, 378 that integrates across capacitor 325. The integration on capacitor 325 causes a change in the voltage at the gate of transistor 332. By changing the voltage applied to the gate of transistor 332, voltage output 320 is changed. As will be appreciated by one of ordinary skill in the art, communicating an error via the differential input pair is relatively slow and results in a lag in voltage output 320 due to a sudden change in load 330.

In addition, the change in voltage at voltage output 320 is communicated via feedback capacitor 385. Using the preceding example, if load 330 drops causing a corresponding droop in voltage output 320, the charge stored in capacitor 385 drops and the current traversing transistors 338, 362 is reduced. This change in current causes capacitor 325 to discharge causing and increases in the voltage at the gate of transistor 332. This causes an increase in current being supplied to load 330. This effectively causes load 330 to look more resistive during a substantial decrease in load 330.

Body filter 393 adds a time constant between the body of transistor 332 and voltage output 320. This time constant operates as a filter that minimizes any ringing that may occur when load 330 is switching. Further, when voltage output 320 droops, capacitor 397 of body filter 393 operates to hold the body of transistor 332 high for a limited period of time. This causes transistor 332 to supply an increased current to voltage output 320 for a short period of time (i.e., provides an increased conductance for a short period of time). This increase in current improves both the phase margin of voltage regulator 300, as well as the instantaneous response of voltage regulator 300.

In alternative embodiments of the present invention, body filter 393 may be replaced with a low impedance source (not shown) whose voltage is near, but always less than the desired output voltage of regulator 300. This low impedance source would be connected to the body of transistor 332. Such a low impedance source would provide a similar current boost as that provided by body filter 393.

Figure 4B:
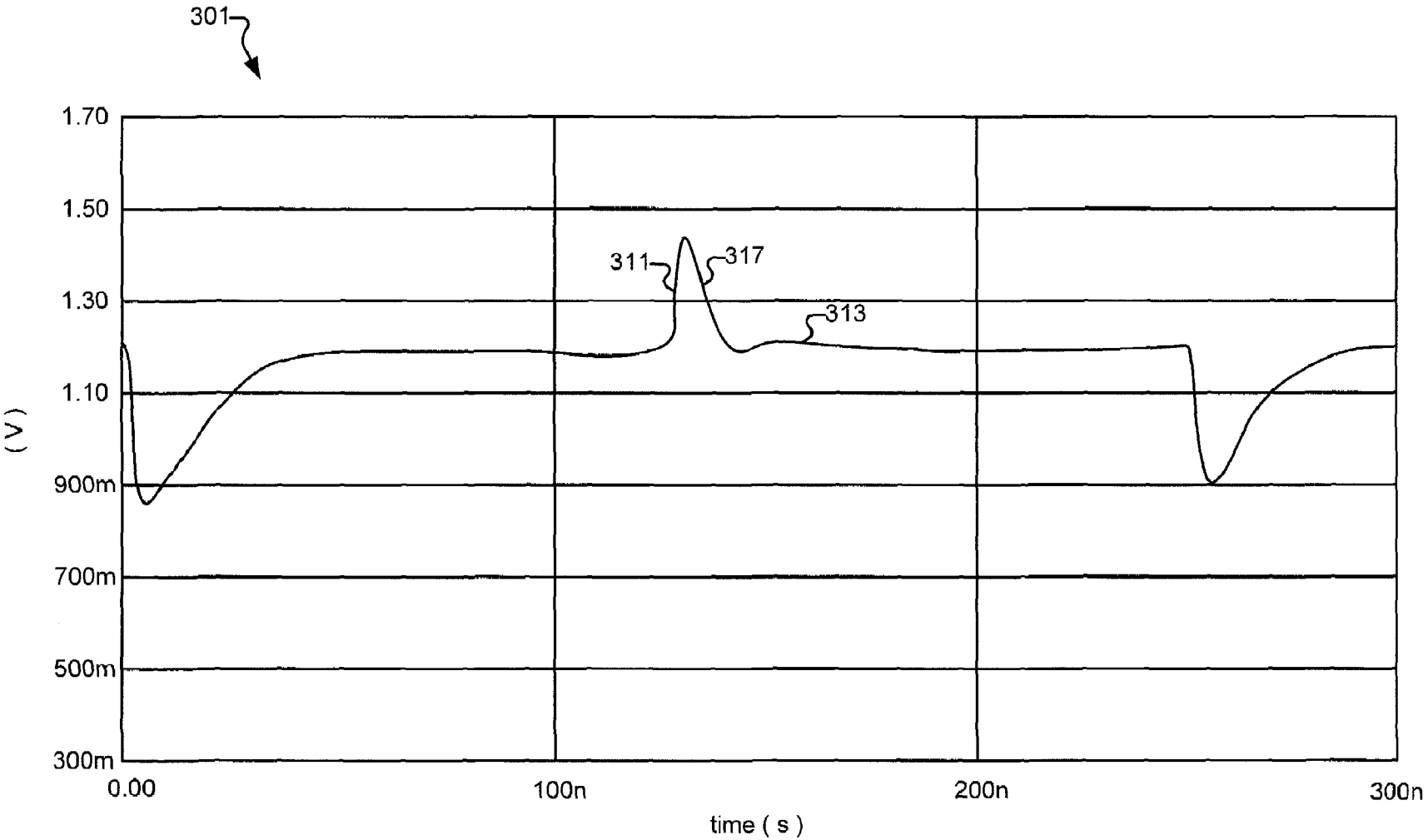
FIG. 4*b* depicts an exemplary operation of the voltage regulator of FIG. 4*a* where a reasonably sized gate capacitor and accompanying body filter are chosen.

Turning to FIG. 4*b*, a graphical representation 301 depicts an exemplary operation of voltage regulator 300. Graphical representation 301 shows a typical load current waveform for voltage regulator 300 operating at 1.2 Volts. As shown by graphical representation 301, voltage regulator 201 provides the fastest response time (time from point 311 to point 313 which is less than thirty nano-seconds) with the lowest voltage disturbance (less than 0.25V) at the output of voltage regulator 300 (i.e., voltage output 320).

In this case, a relatively small capacitor 325 may be utilized (i.e., less than two times the $C_{gs}$ of transistor 332) to provide improved high-frequency power supply rejection. Further, the low-pass time constant of body filter 393 is slower than the high-pass time constant of the filter comprising feedback capacitor 385 and resistor 369. In this case, when load 330 is switched on (at a point 311), a voltage disturbance is created at the source of transistor 332. When this voltage disturbance propagates to the gate of transistor 332, the voltage on the body of transistor 332 is maintained constant for a period controlled by low-pass body filter 393. This constant body voltage acts to oppose any changes in the voltage at the source of transistor 332 through the body transconductance gmb. In this case, gmb is typically twenty to thirty percent of the gate transconductance for a thick-OX MOSFET. As no signal feedback is required to create the aforementioned change in voltage, the opposition occurs almost instantaneously and will act to limit the initial voltage disturbance at the output of the regulator. Thus, the voltage disturbance in this case is substantially less than that of voltage regulator 200. After some time the body voltage will move towards the source voltage; however, by this point the high-pass feedback loop will have responded and started to drive the gate of transistor 332 to move voltage output 320 to its baseline value. High-pass feedback loop comprises the loop extending from the source of transistor 332 through feedback capacitor 385, through transistors 362, 342 can back to the gate of transistor 332. As shown, the voltage on the body of transistor 332 maintained by body filter 393 acts to minimize initial voltage transients (the maximum shown between point 311 and a point 317), while the high-pass feedback loop including capacitor 285 provides a quick return to baseline (at a point 313). In one exemplary embodiment of the present invention, feedback capacitor 385 has a capacitance of one (1) pF, capacitor 325 has a capacitance of 2.3 pF, capacitor 397 has a capacitance of ten (10) pF, and resistor 395 has a resistance of five hundred (500) Ohms. In some cases, one or more of capacitor 325, capacitor 397 and capacitor 385 may include capacitance that is either partially or completely derived from the capacitance of one or more MOS devices. Further, in some cases, clamp devices may be implemented across one or more of the resistors, and the body of one or more of the NMOS devices may be tied to a quiet node to provide increased supply rejection.

As will be appreciated by one of ordinary skill in the art based on the disclosure and figures provided herein, voltage regulators including both high and low speed feedback loops can be implemented. The body filter electrically coupling the body of the pass transistor (e.g., transistor 332) to its source operates to damp out undesirable high frequency positive feedback which was typically present in prior voltage regulators. In previous voltage regulators, a large gate capacitor was typically used to stabilize the regulator operation, but at the expense of regulator recovery rate on load changes. Embodiments of the present invention utilize other approaches for stabilizing the circuit that do not have the disadvantage of slowing the recovery loop. In contrast to the operation of previous voltage regulators, tying the body of the pass transistor to a body filter adds current when a rapid decrease in the load is perceived. This operation is in harmony with that of the overall operation of the voltage regulator. The RC time constant of the body filter is made sufficiently long that the immediate effect decays at a rate consistent with the recovery of the high speed feedback loop after a change in load current. The load current demand eventually shifts from the body damping circuit the gate control as the high speed and low speed loops react in time to the load change, and the charge on the body capacitor decays toward the new output voltage. As will be appreciated, adding the body filter limits the body effect from increasing the Vt of the pass transistor. The resistor of the body filter preserves this advantage at DC, and the capacitor of the body filter provides immediate regulator action through the bulk node transconductance to the regulator output. In some cases, the action of the body filter may be referred to as "bulk active damping".

In conclusion, the present invention provides novel systems, devices, methods and arrangements for improving voltage regulator response time. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A voltage regulation system, the voltage regulation system comprising:

a source follower, wherein the source follower includes a transistor with the source of the transistor providing a baseline voltage at a regulated voltage output node;

a body damping circuit, wherein the body damping circuit includes a resistor electrically coupled between the body of the transistor and the source of the transistor; and a low speed feedback circuit, wherein the low speed feedback circuit is electrically coupled to the gate of the transistor, and wherein the low speed feedback circuit is operable to return the regulated voltage output node to the baseline voltage.

2. The voltage regulation system of claim 1, wherein the voltage regulation system further comprises:

a variable load, wherein the variable load is electrically coupled to the regulated voltage output node.

3. The voltage regulation system of claim 1, wherein the resistor is part of a body filter, wherein the body filter further includes a body capacitor electrically coupled to the body of the transistor, and wherein the body filter is operable to provide a rapid opposition to any voltage disturbance at the regulated voltage output node.

4. The voltage regulation system of claim 1, wherein the voltage regulation system further comprises:

a gate capacitor electrically coupled to the gate of the transistor, wherein the gate capacitor generates a primary pole of the voltage regulation system.

5. The voltage regulation system of claim 1, wherein the transistor is a first transistor, and wherein the low speed feedback circuit includes:

a second transistor, wherein the drain of the second transistor is electrically coupled to the regulated voltage output; and a feedback capacitor, wherein the feedback capacitor is electrically coupled between the regulated voltage output and the gate of the second transistor.

6. The voltage regulation system of claim 1, wherein the voltage regulation system further comprises:

a high speed feedback circuit, wherein the high speed feedback circuit includes a feedback capacitor electrically coupled to the source of the transistor.

7. A voltage regulator, wherein the voltage regulator comprises:

a source follower, wherein the source follower includes a first transistor, and wherein the source of the first transistor is electrically coupled to a regulated voltage output node;

a gate capacitor, wherein the gate capacitor is electrically coupled to the gate of the first transistor;

a body filter, wherein the body filter includes a body resistor and a body capacitor, wherein the body resistor is electrically coupled between the body of the first transistor and the source of the first transistor, and wherein the body capacitor is electrically coupled to the body of the first transistor;

a second transistor, wherein a drain of the second transistor is electrically coupled to the regulated voltage output node; and a feedback capacitor, wherein the feedback capacitor is electrically coupled between the gate of the second transistor and the regulated voltage output node.

8. The voltage regulator of claim 7, wherein a variable load is electrically coupled to the regulated voltage output node.

9. The voltage regulator of claim 8, wherein the body filter is operable to oppose a change in the body voltage of the first transistor caused by a change in the variable load.

10. The voltage regulator of claim 9, wherein opposing the change to the body voltage of the first transistor enforces a rapid increase in current provided to the regulated voltage output node at the occurrence of the change in the variable load.

11. The voltage regulator of claim 8, wherein the feedback capacitor is operable to provide a rapid return to a baseline voltage at the regulated voltage output node after a change in the variable load.

12. The voltage regulator of claim 7, wherein a primary pole of the voltage regulator is generated by the gate capacitor.

13. The voltage regulator of claim 7, wherein a time constant of the body filter is less than a time constant of a high-pass feedback loop including the feedback capacitor.

14. A voltage regulator, wherein the voltage regulator comprises:

a source follower, wherein the source follower includes a transistor, and wherein the source of the transistor is electrically coupled to a regulated voltage output node;

a gate capacitor, wherein the gate capacitor is electrically coupled to the gate of the transistor; and a body filter, wherein the body filter includes a body resistor and a body capacitor, wherein the body resistor is electrically coupled between the body of the transistor and the source of the transistor, and wherein the body capacitor is electrically coupled to the body of the transistor.

15. The voltage regulator of claim 14, wherein a variable load is electrically coupled to the regulated voltage output node.

16. The voltage regulator of claim 15, wherein the body filter is operable to oppose a change in the body voltage of the transistor caused by a change in the variable load.

17. The voltage regulator of claim 14, wherein the transistor is a first transistor, and wherein the voltage regulator further comprises:

a second transistor, wherein a drain of the second transistor is electrically coupled to the regulated voltage output node; and a feedback capacitor, wherein the feedback capacitor is electrically coupled between the gate of the second transistor and the regulated voltage output node.

18. The voltage regulator of claim 17, wherein the feedback capacitor is operable to provide a rapid return to a baseline voltage at the regulated voltage output node after a change in the variable load.

19. The voltage regulator of claim 14, wherein a primary pole of the voltage regulator is generated by the gate capacitor.

* * * * *